US006223631B1

(12) United States Patent
Osa

(10) Patent No.: US 6,223,631 B1
(45) Date of Patent: May 1, 2001

(54) ADJUSTABLE SPANNER

(76) Inventor: Ana Urquizu Osa, Olaguibel, 38, 01004 Vitoria (ES)

( * ) Notice: Subject to any disclaimer, the term of this patent is extended or adjusted under 35 U.S.C. 154(b) by 0 days.

(21) Appl. No.: 09/355,526

(22) PCT Filed: Jan. 28, 1998

(86) PCT No.: PCT/ES98/00020

§ 371 Date: Jul. 29, 1999

§ 102(e) Date: Jul. 29, 1999

(87) PCT Pub. No.: WO98/33626

PCT Pub. Date: Aug. 6, 1998

(30) Foreign Application Priority Data

Feb. 3, 1997 (ES) ..... 9700204
Feb. 9, 1998 (ES) ..... 9800026

(51) Int. Cl.[7] ..... B25B 13/16
(52) U.S. Cl. ..... 81/157; 81/165
(58) Field of Search ..... 81/157, 165, 170

(56) References Cited

U.S. PATENT DOCUMENTS 1,402,686 1/1922 Trabold .
2,724,301 11/1955 Parent et al. ..... 81/145
5,209,144 * 5/1993 Lu Guoji ..... 81/165

FOREIGN PATENT DOCUMENTS 2139047Y 7/1993 (CN) .
0.509.501 A1 10/1992 (EP) .
1.182.603 6/1959 (FR) .
1.126.534 10/1972 (FR) .

* cited by examiner

*Primary Examiner*—James G. Smith
(74) *Attorney, Agent, or Firm*—Nath & Associates PLLC; Gary M. Nath; Harold L. Novick

(57) ABSTRACT

Monkey wrench, of the type built up of a fixed clamp (1) solidary with the grip and a mobile jaw (2) provided with a rack (3) in which an operation shaft (5) is engaged, and in which the drive nut (4) is disposed on a shaft (5) built up of a flexible elastomer material, remaining the mentioned shaft (5) configured by a compact cylindrical body with a diameter in correspondence with the respective installation housing (6); and because in the assembly disposition of the mentioned shaft (5) it remains slightly deflected, exercising a pushing of the nut (4) towards the rack (3) of the mobile jaw (2), with the possibility to separate the mentioned nut (4) regarding the mentioned rack (3) of the mobile jaw (2), by forced displacement of the nut (4) against the action of the indicated shaft (5).

8 Claims, 6 Drawing Sheets

ADJUSTABLE SPANNER

The monkey wrenches consist in a set built up of a fixed clamp that forms a body of one only piece with the tool handle and a mobile jaw that is moveable in approach and separation regarding the mentioned fixed clamp, this mobile jaw is provided with a toothed rack, with which it engages a drive worm that is mounted in such a way it can turn freely on a shaft.

Conventionally, the mentioned drive worm is disposed on a rigid metallic shaft, incorporating, in one end of the worm housing, a pusher spring, so as to avoid this way the axial looseness of the worm. The movable jaw remains nevertheless with a certain looseness in the gear with regard to the worm, which causes undesirable noises when moving the key.

To avoid that problem of the looseness of the mobile jaw, a solution is known. It consists in preparing the drive worm divided into two axially consecutive parts, with a reduction of the separation between the fillet carvings of the gear thread with the mobile jaw, in the area of the mentioned worm division, with which, by virtue of the pushing of the spring, which eliminates the axial looseness the contact of the lateral parts of the fillets of the threading of one of the two parts of the worm components is produced, against the lateral faces of the rack teeth of the mobile jaw, avoiding with it the looseness of the mentioned mobile jaw. The execution and assembly of this solution is however complicated, being it moreover expensive to carry out the worm in two independent pieces.

A solution is also known to allow the separation of the drive worm regarding the gear with the mobile jaw, so as to allow the quick movement of the mentioned mobile jaw; in the way it is indicated in the U.S. Pat. Nos. 1,402,686 and 2,724,301. With this same concept, the Chinese patent 92242425 offers a solution according to which a helical spring is disposed as the shaft of the worm. It is compressed between two extreme balls that support against some inclined planes, with which, when pulling at the worm in the sense of their separation with respect to the rack of the mobile jaw, the sliding of the extreme balls of the shaft along the inclined supporting planes, makes that the spring that forms the shaft is compressed axially at the same time as it moves together with the worm in the separation sense respect to the rack of the mobile jaw, allowing this way the liberation of the mobile jaw with regard to the worm.

French Patent 2.126.534 discloses a solution in which the worm is forced by a flexible element to be always in engagement with the rack of the mobile jaw; this flexible element allowing that the worm may be pushed out of engagement with the rack (3).

In all the embodiments already known, the construction is in fact expensive and the assembly really difficult. Furthermore, in order to avoid that the worm is moved excessively in transverse direction, the flexible element must be complemented with a shaft, which is in fact formed in the support of the worm.

In accordance with the present invention a key is proposed which adopts a new assembly solution for the drive worm, to be able to join the two previously mentioned functions, eliminating the looseness and with the possibility to liberate the mobile jaw, obtaining some more advantageous constructive and functional characteristics than with the solutions up to now developed.

The new solution consists in preparing the drive worm on a flexible shaft of elastomer material, according to an assembly disposition so that this shaft, because of its flexion, pushes the mentioned drive worm towards the mobile jaw.

This way, a radial pressure of the drive worm is reached, against the mobile jaw, which, in combination with the inclination of the flanks of the teeth and the gear threads between both pieces, cancels the slackness of the gear, reaching this way a certain fixation of the mobile jaw, so that undesirable noises do not take place.

The own flexibility of the shaft allows, on the other hand that the drive worm can be moved in a forced way in the opposite sense of its pressure against the mobile jaw, thanks to the elastic deformation of the shaft.

This allows to liberate the mobile jaw from its connection with the drive worm, so as to leave this mobile jaw free from a quick displacement in the approaching or separating sense regarding the fixed clamp, with which the adjusting of the wished opening of the key is easier and quicker.

In combination with that displacement possibility of the drive worm, until the release of the gear between the worm and the mobile jaw is reached, a realization of the teeth and of the gear thread is foreseen with a lateral one according to some inclined planes, with an inclination orientated in the sense of approach of the mobile jaw towards the fixed clamp.

With it such a disposition is obtained that, by means of a simple push of the mobile jaw towards the fixed clamp, an elastic jump of the rack teeth of the mentioned mobile jaw takes place regarding the threads of the drive worm, due to the displacement in the separation sense to which the mentioned worm is subjected when sliding the inclined lateral plane of its fillets on the inclined lateral plane of the rack teeth of the mobile jaw, reaching this way a ratchet effect that allows the quick closing of the key by means of only the push of the mobile jaw towards the fixed clamp.

This particularity supposes a great advantage for the handling of the key, since it allows its quick closing for its approach to the measure of the object on which it has to act, being able to carry out that closing in an easy way, even in uncomfortable and difficult positions, since it is only necessary to push the mobile jaw towards the fixed clamp, which is executable by the user with a single hand, allowing this way the performance of the wrench in a much easier way in places where the access with both hands at the same time is difficult or impossible. It is worth pointing out in this respect that the approaching movement of the jaws is the one which particularly interests in a quick way when using the wrench, since the wrench should be prepared with a sufficiently open width, to insert it on the actuation element, on which it is adjusted once inserted; while to retreat the wrench, once carried out the performance, only a slight separation of the jaws is necessary to be able to retire the wrench without difficulty.

The liberation of the mobile jaw regarding the gear with the drive worm, by the movement of the latter, allows that this mobile jaw can even be extracted out of its housing assembly in the wrench, in combination with which a realization with the provided mobile jaw of a plane front in one of its parts and with incorporation of a toothed piece in the opposed front, in such a way that, by means of the extraction of the mentioned mobile jaw out of its assembly housing, the position of the same can be inverted regarding the fixed clamp, allowing this way the adaptation of the wrench to act on polygonal elements and also to act on cylindrical elements.

The flexible elastomer shaft of the drive worm is built up of a compact cylindrical body of a diameter in correspondence with the assembly housing of the wrench, being the fixed disposition of the mentioned shaft foreseen in a preferable way by means of the gluing of its ends in the assembly housing; although also, without modifying the essential of the invention, the mentioned shaft body can incorporate a threaded head in a solidary way joined in one end, for the fastening by means of a threaded assembly in the corresponding housing.

The shaft body can moreover incorporate, in an optional way, inside the elastomer material, reinforcements with the help of bars or metallic plates, by means of which at the same time the flexion strength of the mentioned shaft can be reinforced.

In view of all this, the mentioned monkey wrench object of the present invention indeed has some very advantageous characteristics as compared to the conventional monkey wrenches.

FIG. 1 represents a monkey wrench in agreement with the scope of the invention.

FIG. 1*a* is an enlarged partial view corresponding to the end where the head of the wrench is situated.

Figure 4:
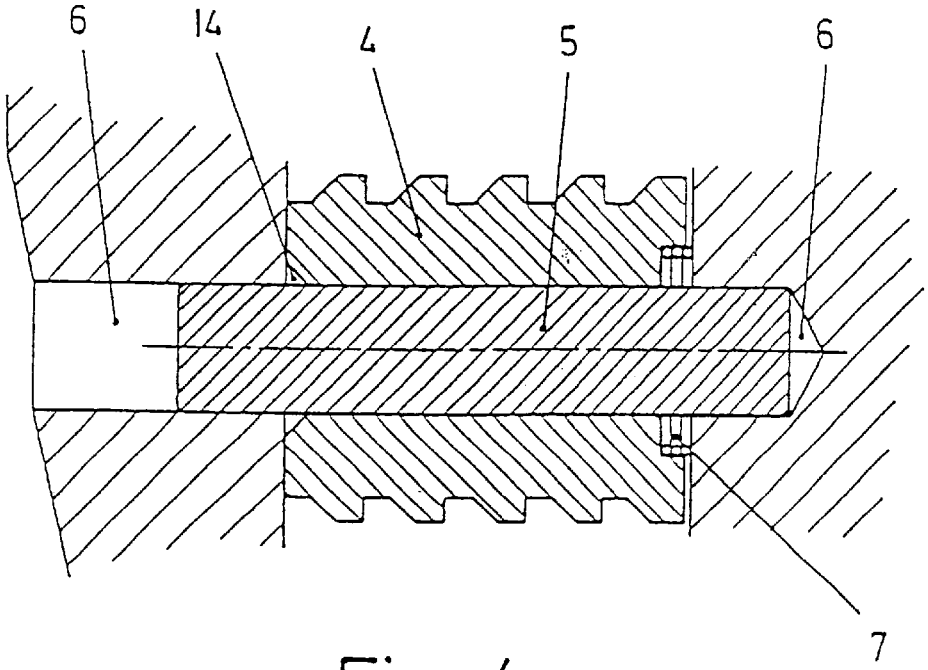
FIG. 4 is a detail in an enlarged section of the drive worm assembly of the wrench in its disposition on the corresponding flexible shaft, according to a non limitative example of a practical realization.
Figure 4A:
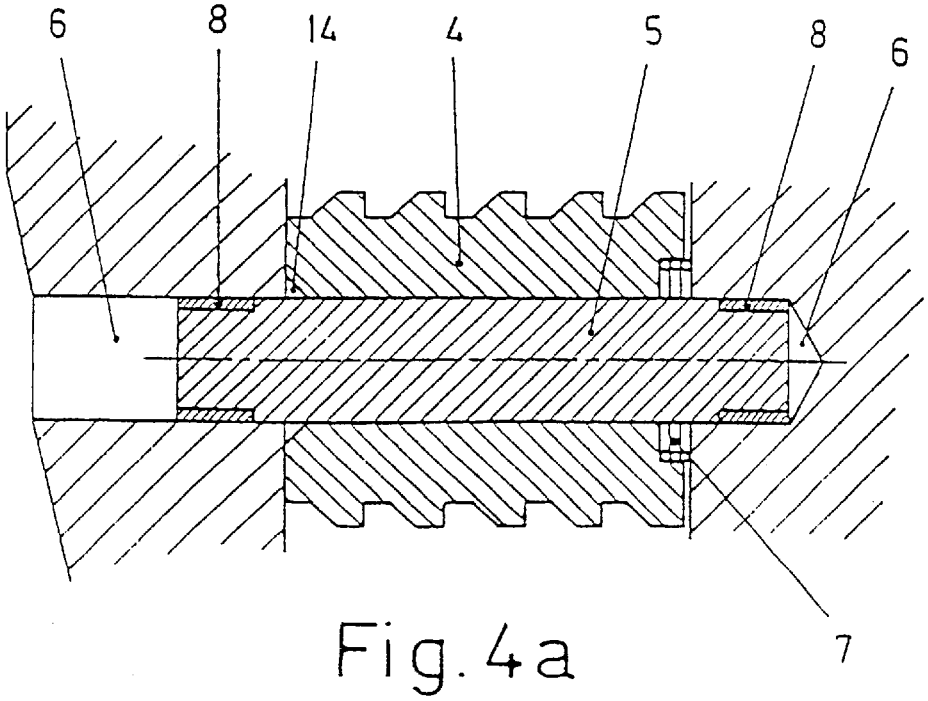

FIG. 4*a* is a detail as the previous one, with the flexible shaft of the worm provided with bushings incorporated at the ends.

Figure 5:
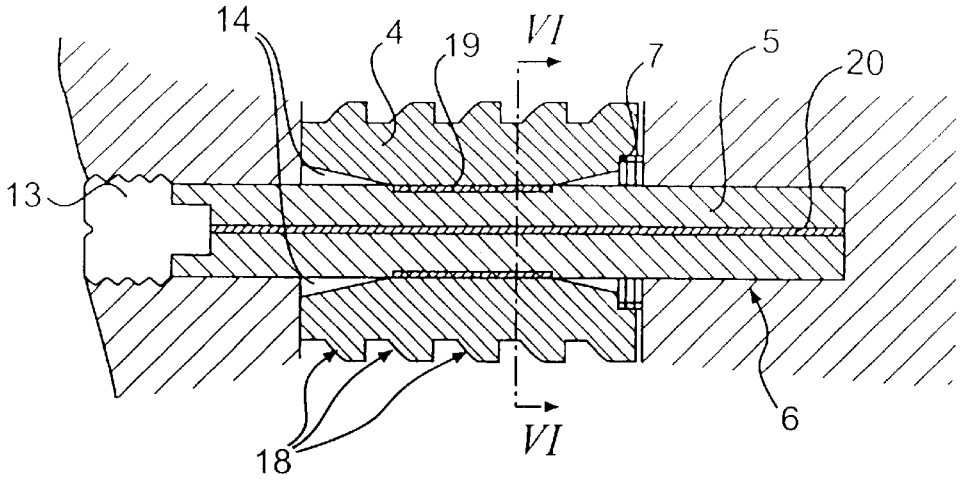

FIG. 5 is a similar detail of the assembly of the drive worm of the wrench in its disposition on the corresponding flexible shaft, according to another realization example.

Figure 6:
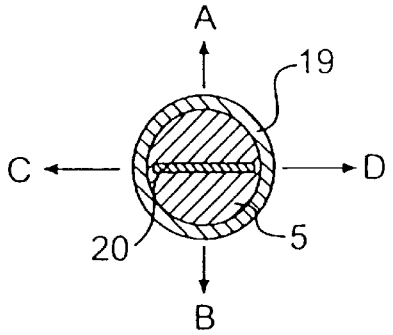

FIG. 6 is a traverse section of the flexible shaft according to the indication VI—VI pointed out in the detail of the previous figure, having represented some radial arrows around A, B, C, and D which indicate the flexion and rigidity directions of the mentioned shaft in this realization.

Figure 7:
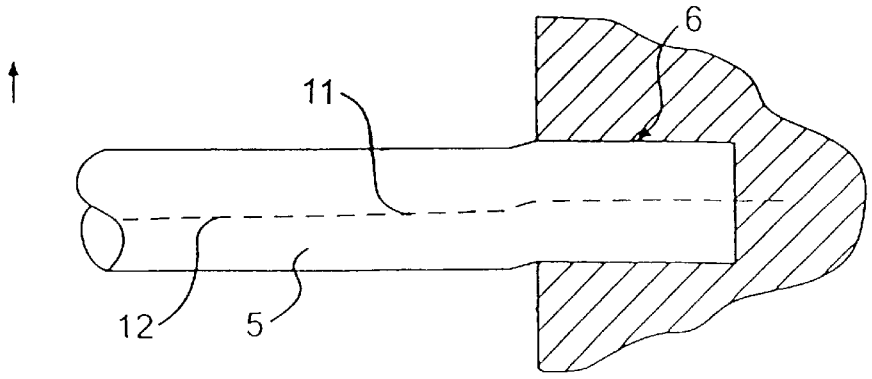

FIG. 7 is a detail in an outline that shows the radial deviation in the assembly between the half part of the flexible shaft which incorporates the drive worm and the ends of the mentioned shaft.

Figure 8:
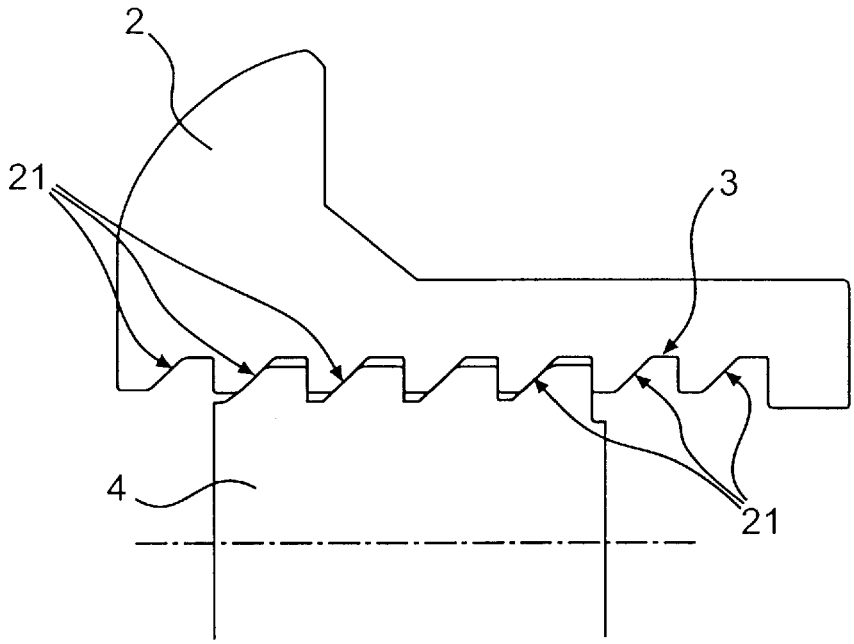

FIG. 8 is an outline that represents the sliding gear towards one side between the rack of the mobile jaw and the drive worm.

Figure 9:
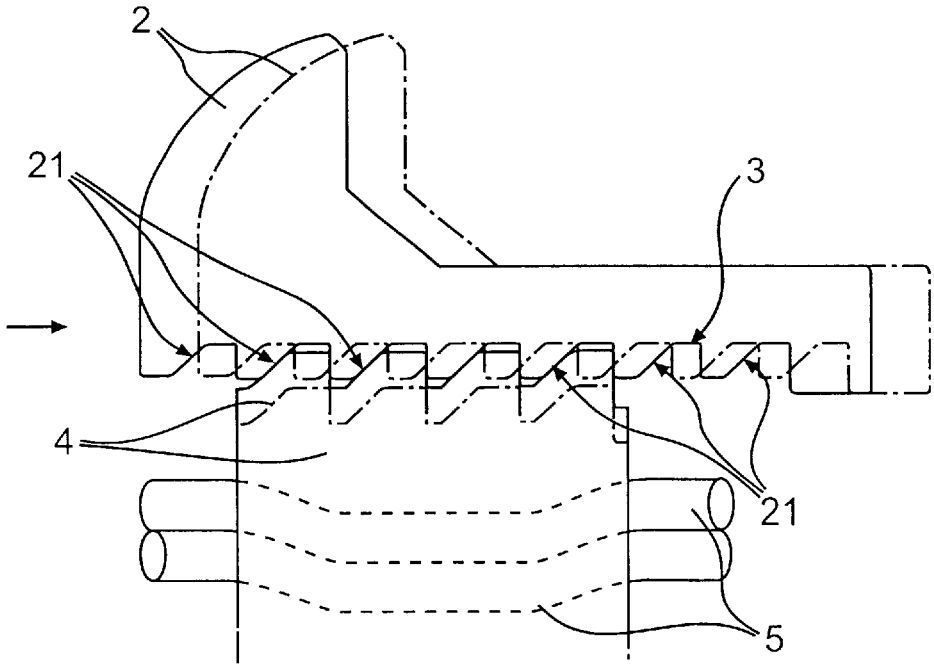

FIG. 9 is a representation as the one of the previous outline, being indicated in "dot and dash line" the position of the drive worm and of the mobile jaw in the jump of the gear between both when the mobile jaw is pushed.

Figure 10:
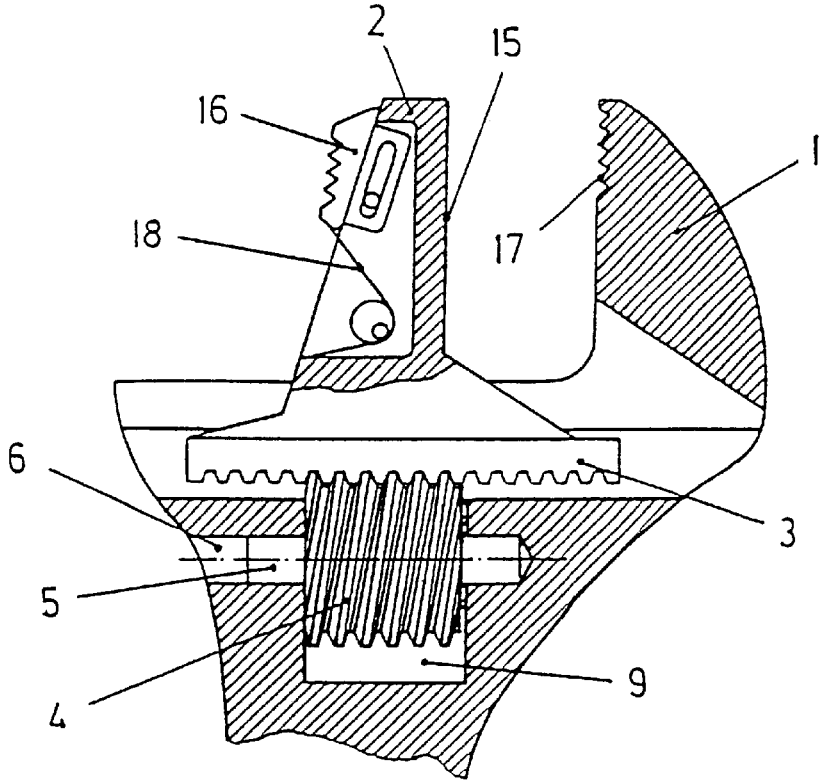

FIG. 10 is a sectional lateral view of the wrench head, according to a realization of a reversible assembly of the mobile jaw.

Figure 10A:
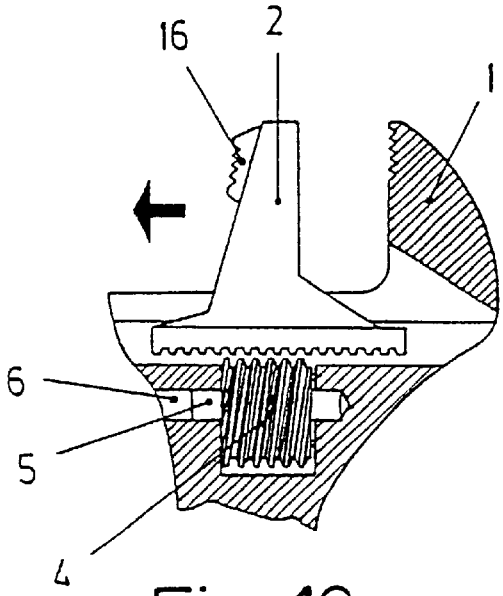

FIG. 10*a* is a representation to a smaller scale of the wrench head in the realization of the previous figure, with the drive worm disengaged regarding the mobile jaw.

Figure 10B:
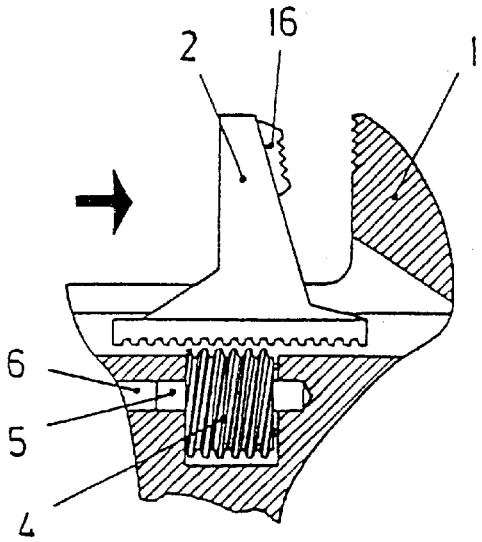

FIG. 10*b* is a representation as the previous one, with the mobile jaw inverted in its position regarding the fixed clamp.

The invention refers to a monkey wrench of the ones that include a fixed clamp (1) forming an only piece with the body of the handle and a mobile jaw (2), moveable in the approach and separation senses with regard to the mentioned fixed clamp (1), possessing the mentioned mobile jaw (2) a toothed rack (3), with which a drive worm (4) is connected, prepared in free turn on a shaft (5), so that the turning operation of the mentioned worm (4) causes the displacement of the mobile jaw (2).

In accordance with the invention, the drive worm (4) is disposed incorporated on a shaft (5) of elastomer material, such as rubber or similar, so that the mentioned shaft (5) is flexible, being foreseen its disposition according to an assembly with tendency to push the worm (4) towards the mobile jaw (2).

That pushing effect of the worm (4) towards the mobile jaw (2) is reached by the flexibility of the shaft (5) itself and its assembly disposition, since in the assembly the mentioned shaft (5) is disposed in such a way that its ends are included in a housing (6) whose longitudinal shaft (11) is located with regard to the mobile jaw (2) at a distance somewhat smaller than the own central shaft (12) of the worm (4), in the way it is represented in FIG. 7, with which the shaft (5) remains exercising, a push of the mentioned worm (4) towards the mobile jaw (2), because of its flexible recovery effect.

This way, the worm (4) remains pressed against the mobile jaw (2), with which the looseness of the gear between both pieces is cancelled, being this way the mobile jaw (2) with a fixation that avoids its free mobility in the clearance, with which a greater precision is obtained as well as a softness in the displacement of the mentioned mobile jaw (2), avoiding the noises because of the looseness of the assembly.

In a conventional way, the worm (4) is also pushed axially by a spring (7), as it can be observed in FIGS. 4 and 5, with which the clearance in this axial sense is also eliminated, also avoiding this way that noises take place because of the looseness in that axial sense.

The flexible shaft (5) is built up of a compact cylindrical body, with a diameter in correspondence with the assembly housing (6) in the wrench, determining the mentioned cylindrical body with a very refined external surface, so that in the disposition of the worm assembly (4) the latter can slide on the mentioned shaft (5), allowing a gentle operation of the necessary rotation for the displacement of the mobile jaw (2).

The assembly of the mentioned shaft (5) is established with a fixation of its ends in the corresponding housing (6), for which, according to a possible practical realization, it is foreseen that the extreme parts of the mentioned shaft (5) remain fixed in the housing (6) by means of its gluing.

This gluing fixation can be carried out directly between the ends of the shaft body (5) and the housing wall (6), in the way it is represented in FIG. 4, in which case it is necessary to use glue that is compatible with the elastomer material that builds up the mentioned shaft body (5).

According to a possible realization variant, at the ends of the shaft (5), some bushings (8) can be incorporated, in the way it is represented in FIG. 4*a,* the mentioned bushings (8) can be of any rigid material that allows the use of all kind of glues, for example for metallic material; to establish the shaft fixation (5) in such a case, by means of the gluing of the mentioned bushings (8) on the wall of the housing (6).

In such a realization the bushings (8) are incorporated preferably by means of their integration in the moulded production of the synthetic body of the shaft (5), being foreseen that the mentioned bushings (8) are provided with holes and/or grooves so that the elastomer material of the moulded body is inserted in them, being this way an only monoblock body. The mentioned bushings (8) could however be incorporated on the ends of the shaft (5), by means of any other solidarization technique, without altering the essentiality of the invention.

According to another possible realization, a threaded head (13) can be incorporated to the synthetic body of the shaft (5) which is solidarily united at an end, allowing this way the attachment of this shaft (5) by means of an assembly threaded into the housing (6), in the way it is represented in FIG. 5.

On the other hand the worm (4) is foreseen with some widenings at the end of its axial passage hole of the shaft (5), with which the mentioned ends of the worm (4) remain with a clearance regarding the mentioned shaft (5), allowing a certain radial flexion of the shaft body (5) in those areas in the assembly disposition.

The mentioned radial flexion possibility of the shaft (5), allows the forced displacement of the worm (4) in the sense of its separation regarding the rack (3) of the mobile jaw (2), being able to remain this worm (4) completely disjointed from the engagement with the mentioned rack (3) of the mobile jaw (2), being then the mentioned mobile jaw (2) free of displacement, in such a way that it can be moved in a quick way and without the need of the revolvable drive worm (4), for the approach or separation regarding the fixed clamp (1).

To facilitate the manipulation of the worm in any event (4),both in its revolvable operation for the slow mobility of the mobile jaw (2), and in the radial displacement for the quick mobility of this mobile jaw (2), the lower part of the housing (9) defines a bevel (10) in its external lateral faces. This allows a free sliding of the user's fingers in the operation, facilitating this way the manipulation.

Figure 1:
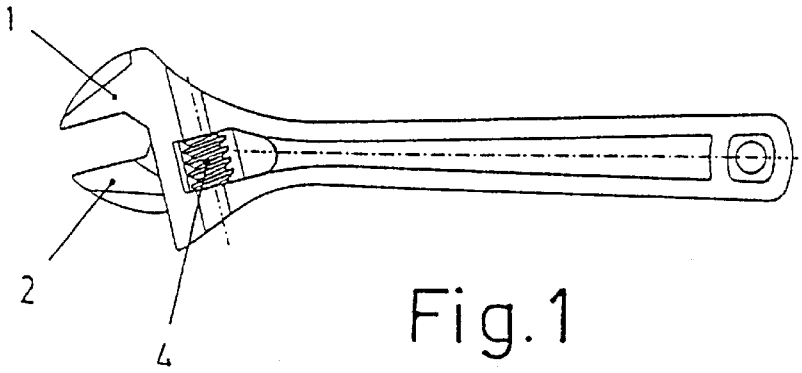
Figure 1A:
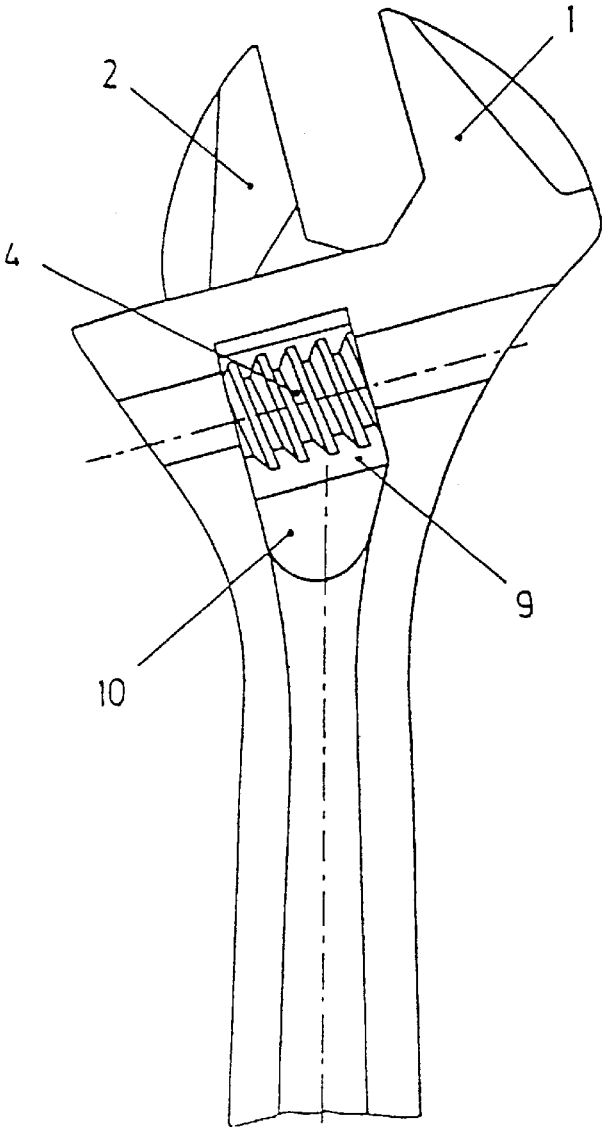
Figure 2:
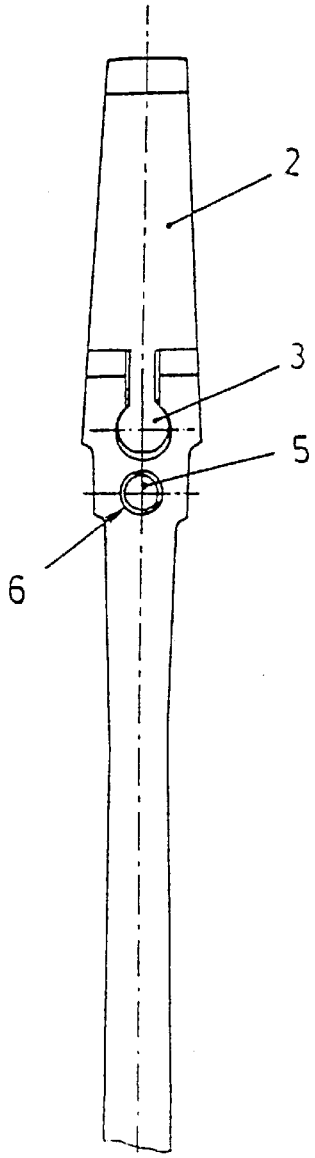
FIG. 2 is a corresponding profile of the same extreme part of the wrench represented in the previous figure.
Figure 3:
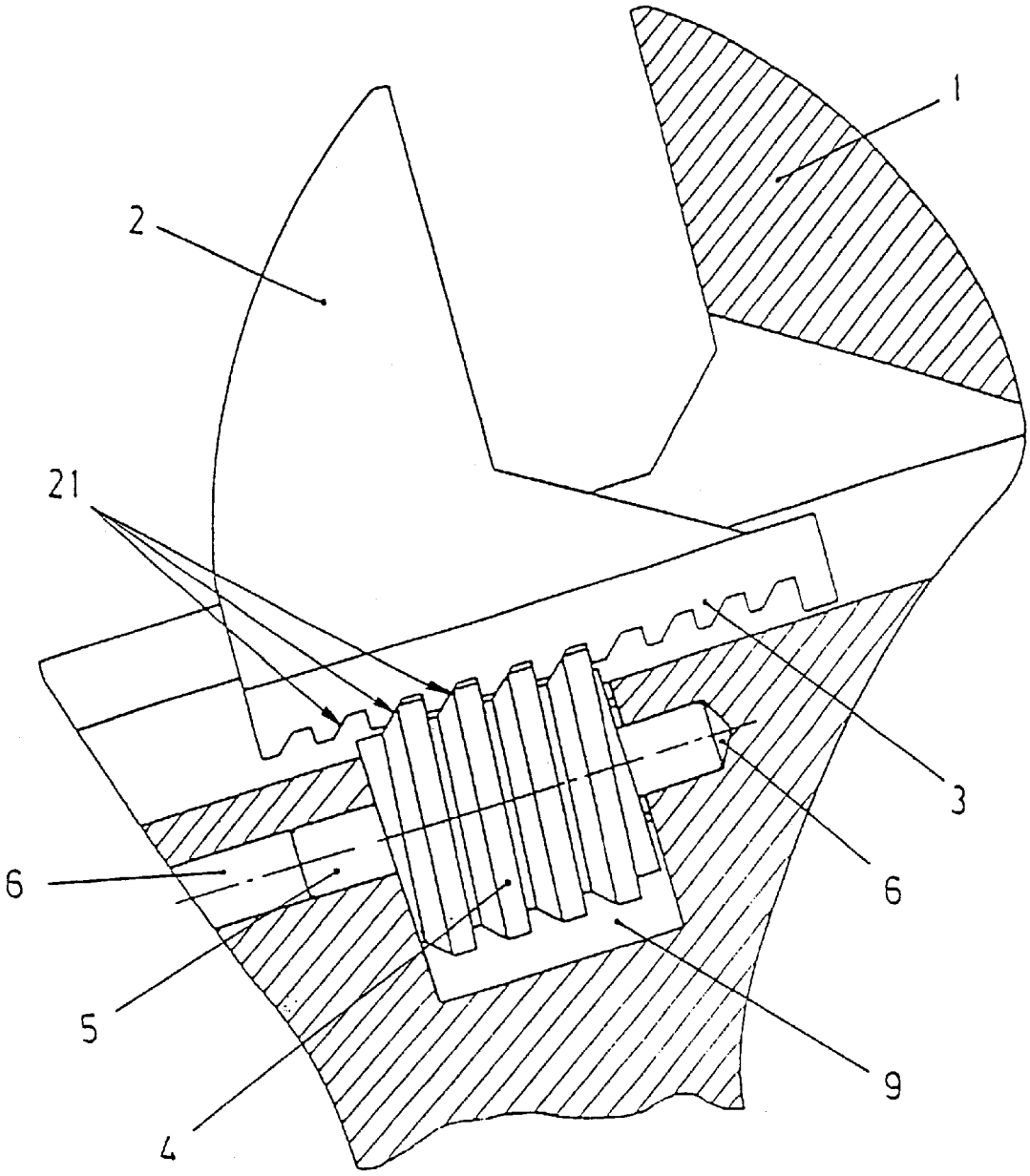
FIG. 3 is a section lateral view and at greater scale of the wrench head.

In combination with the possibility of a radial displacement of the worm (4) by the elastic flexion of the shaft (5), a realization is foreseen so that the helical ribs of the worm (4) and the corresponding rack teeth (3) of the mobile jaw (2) determine some reciprocal inclined planes (21), in one of the sides, as it can be observed in FIG. 3.

With it, the support between the indicated helical ribs of the worm (4) and the mentioned teeth of the mobile jaw (2) results in a sliding effect in the sense of approach of this mobile jaws (2) towards the fixed clamp (1), which allows that, by means of the pushing of the mobile jaw (2) towards the fixed clamp (1), the closing of the wrench can be carried out immediately, due to the sliding jump of the teeth of the mobile jaw (2) on the helical ribs of the worm (4) in combination with the radial displacement of the worm (4), by the pushing that this one suffers in consequence in the radial sense, giving rise to a ratchet effect.

The liberation of the mobile jaw (2) by the forced radial displacement of the worm (4), allows that the mentioned mobile jaw (2) can even be extracted out of its assembly housing in the wrench.

In combination with it, a realization of the mobile jaw (2) is foreseen provided with a flat front (15) in one of its parts and with incorporation of a toothed piece (16) in the opposed part, with which, by means of the extraction of the mentioned mobile jaw (2) of its assembly housing, its position can be inverted, in the way it is represented in FIGS. 10*a* and 10*b*, allowing this way the adaptation of the wrench to act on polygonal elements, by means of the disposition with the flat front (15) opposed to the fixed jaw (1), or to act on cylindrical elements, by means of the disposition with the piece (16) faced to the fixed jaw (1), in which a corresponding toothed front (17) is foreseen to such an effect.

In a particular way, the toothed piece (16) is foreseen according to a sliding assembly, acted by a spring (18) towards a fixed position, with the purpose of facilitating the operative disposition of the wrench on the cylindrical elements of application with the necessary adjustment so that the performance of the wrench is effective.

The flexible shaft (5) of assembly of the worm (4) can be of any elastomer material that allows an appropriate elasticity and which at the same time has the necessary rigidity to support the worm (4) in its operative disposition, having carried out satisfactory tests, to such an effect and in connection with a disposition of the mentioned shaft (5) directly glued with regard to the assembly housing (6), with a realization of the mentioned shaft (5) with the help of natural elastomer materials, such as rubber or synthetic material as for example acryl-nitrile-butadiene "NBR", or chloroprene polymers "CR"; but in general, practically, the realization of the mentioned shaft (5) can be carried out by any kind of elastomers, such as silicone, "VMQ", fluoric silicone "FUMQ", polyacrylates "ACM", or those of the type "HNBR", "FKM", "EPDM", etc . . . .

The determination of the shaft (5) by a cylindrical body of an only piece, allows its obtaining by simple cutting starting from a continuous body; but in a same way the acquisition can be by moulding, being able to adapt the conformation that is required in each case, even with different sections as it suits to the application disposition in the wrench.

This does not suppose an alteration of the essentiality of the object, the mentioned cylindrical body of the shaft (5) can be supplemented with false accessory elements, such as the extreme bushings (8) themselves for the gluing into the housing (6), or other pieces of a similar finish, as well as a central bushing (19) to facilitate the revolvable sliding of the worm (4), or flexible elements, such as bars or strips (20) integrated inside the elastomer material, to reinforce the resistance and the strength of the flexibility of the elastomer material in the way it is represented in FIG. 5.

In the case of inclusion of a flat strip (20) in the inside, the flexion of the shaft (5) is guided, whenever, considering the directions indicated in FIG. 6, the flat strip (20) can only bend according to the direction A-B, determining on the contrary undeformable rigidity in the direction C-D. This makes that the flexion of the shaft (5) can be established only to act in the sense in which the mobile jaw (2) is formed, being on the contrary rigid in the perpendicular sense, which avoids that an undue flexion of this shaft (5) can take place in the sense C-D by the pushing exercised when the worm (4) is being operated by the user.

What is claimed is:

1. A Monkey wrench, of the type comprising a handle, a fixed jaw integral with the handle, a mobile jaw provided with a rack, the mobile law slidingly engaged in the handle, and a drive worm for operative connection with the rack, said drive worm held in connection with the rack by the flexible element being displaceable so that the drive worm can be disconnected from operative connection with the rack, the monkey wrench being characterised in that:

said flexible element is a shaft comprising a flexible elastomer material, said shaft having two ends and further comprising a cylindrical body received in a bore of a housing portion of the handle;

wherein in the assembly of said shaft in the handle, said shaft is slightly bent whereby the drive worm is biased against the rack of the mobile jaw, said drive worm being displaceable out of engagement with said rack by a pressure applied against the bias action of said shaft.

2. Monkey wrench according to claim 1, further characterized in that both ends of said shaft are received in said bore in the housing portion; and said shaft is fixed to the housing portion by means of gluing each end of said shaft to a wall of the bore in which it is received.

3. Monkey wrench, according to claim 1, further characterized in that the shaft includes two bushings, each bushing being fixed to corresponding ends of the shaft; and each bushing being glued to a wall of the bore.

4. Monkey wrench, according to claim 1, further characterized in that said shaft includes a threaded head at one of said two ends, the threaded head being engaged in a corresponding thread in the bore.

5. Monkey wrench, according to claim 1, further characterized in that said shaft includes a flat strip embedded in the flexible elastomer material whereby the flat strip and the shaft can be deflected in a first lateral direction thereby allowing the drive worm (4) to be moved out of engagement with the rack; said shaft being rigid in a second lateral direction, perpendicular to the first lateral direction.

6. Monkey wrench, according to claim 1, further characterized in that the cylindrical body further comprises a refined external surface over which the drive worm is rotatable slidable.

7. Monkey wrench, according to claim 1, further characterized in that the shaft includes on a central portion thereof an external bushing on which the drive worm is rotatably supported.

8. Monkey wrench, according to claim 2, further characterized in that the shaft includes two bushings, each bushing being fixed to corresponding ends of the shaft; and each bushing being glued to a wall of the bore.

* * * * *

UNITED STATES PATENT AND TRADEMARK OFFICE

CERTIFICATE OF CORRECTION

PATENT NO. : 6,223,631 B1
DATED : May 1, 2001
INVENTOR(S) : Ana Urquizu Osa

It is certified that error appears in the above-identified patent and that said Letters Patent is hereby corrected as shown below:

Claim 1,
Line 5, after "by" insert -- a flexible element, --

Signed and Sealed this

Twentieth Day of November, 2001

*Attest:*

Nicholas P. Godici

NICHOLAS P. GODICI
*Acting Director of the United States Patent and Trademark Office*

*Attesting Officer*